United States Patent [19]

Kovacic et al.

[11] Patent Number: 4,706,065

[45] Date of Patent: Nov. 10, 1987

[54] PULL STATION

[75] Inventors: Charles R. Kovacic, Mundelein; David A. Noshay, Crystal Lake, both of Ill.

[73] Assignee: Honeywell Inc., Minneapolis, Minn.

[21] Appl. No.: 787,350

[22] Filed: Oct. 11, 1985

[51] Int. Cl.[4] ..... G08B 25/00

[52] U.S. Cl. ..... 340/303; 340/308

[58] Field of Search ..... 340/303, 308, 514, 301

[56] References Cited

U.S. PATENT DOCUMENTS

| | | | |
|---|---|---|---|
| 2,083,324 | 6/1937 | Edwards . | |
| 2,594,369 | 4/1952 | Verkuil et al. . | |
| 2,726,381 | 12/1955 | Verkuil . | |
| 2,985,741 | 5/1961 | Ellmann . | |
| 3,715,743 | 2/1973 | Denton . | |
| 4,280,120 | 7/1981 | Trafford et al. | 340/303 |

*Primary Examiner*—Ulysses Weldon
*Assistant Examiner*—Ralph E. Smith
*Attorney, Agent, or Firm*—Donald J. Lenkszus

[57] ABSTRACT

A pull station having a housing of unitary construction with integral cover and base portions, the cover portion having a handle so that the cover portion can be pulled away from the base portion when a signal, such as an alarm signal, is to be generated, a break glass holder provided on one of the portions for receiving a glass structure to be broken when the cover portion is pulled away from the base portion, a glass breaker provided on the other of the portions, the glass breaker having a camming surface to ride over the glass structure when the portions are closed and having a breaking surface for breaking the glass structure when the cover portion is pulled away from the base portion, and a signal generator for generating a signal when the cover portion is pulled.

19 Claims, 4 Drawing Figures

PULL STATION

BACKGROUND OF THE INVENTION

The present invention relates to a pull station for providing a signal, such as an alarm signal, upon manual activation and, more particularly, to such a pull station having a glass bar breaking mechanism with a camming surface for riding over the glass bar when the pull station is closed and for breaking the glass bar when the pull station is opened.

Pull stations are normally located throughout buildings so that, in the event of a fire or other emergency condition, the pull station can be operated to generate an alarm. Typically, the alarm will activate an audible signal within the building in which the pull station has been activated, and the pull station may also transmit a remote alarm to fire and/or police stations in order to summon assistance.

Typical pull stations comprise either a lever which can be pulled down to break a glass bar and to activate a switch for generating the local and/or remote alarm signals or a housing having a glass window which can be broken to permit access to a switch. In either case, the glass is designed to prevent accidental operation of the pull station and to permit only intentional activation. These pull stations are complex and are costly to construct and maintain. The pull station according to the present invention, because of its much simpler construction, addresses these difficulties.

SUMMARY OF THE INVENTION

Accordingly, the present invention is directed to a pull station for generating a signal, such as an alarm signal, upon manual activation having a housing of unitary construction, which housing has integral cover and base portions, the cover portion having a handle so that the cover portion can be pulled away from the base portion when the signal is to be generated, a break glass holder provided on one of the portions for receiving a glass structure to be broken when the cover is pulled away from the base, a glass breaker provided on the other of the portions, the glass breaker having a camming surface to ride over the glass structure when the portions are closed and having a breaking surface for breaking the glass structure when the cover portion is pulled away from the base portion, and an alarm signal generator for generating an alarm signal when the cover portion is pulled.

BRIEF DESCRIPTION OF THE DRAWINGS

These and other features and advantages will become more apparent from a detailed consideration of the invention when taken in conjunction with the drawings in which.

DETAILED DESCRIPTION

The pull station is constructed of a unitary housing having integral base and cover portions 11 and 12 respectively, base portion 11 and cover portion 12 being integrally joined together by hinge 13.

Figure 1:
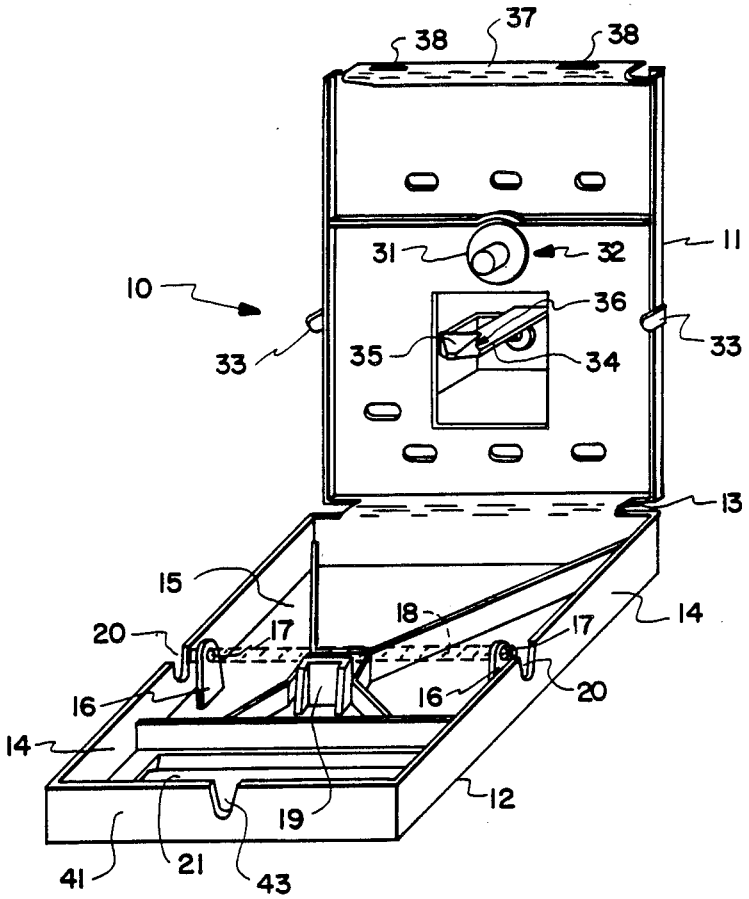
FIG. 1 is a perspective view of the pull station particularly showing the inside of the cover and base portions.
Figure 2:
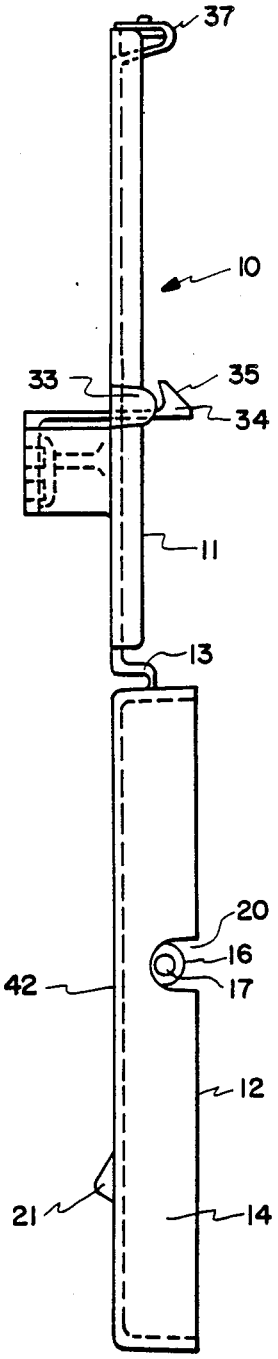
FIG. 2 is a side view of the pull station.
Figure 3:
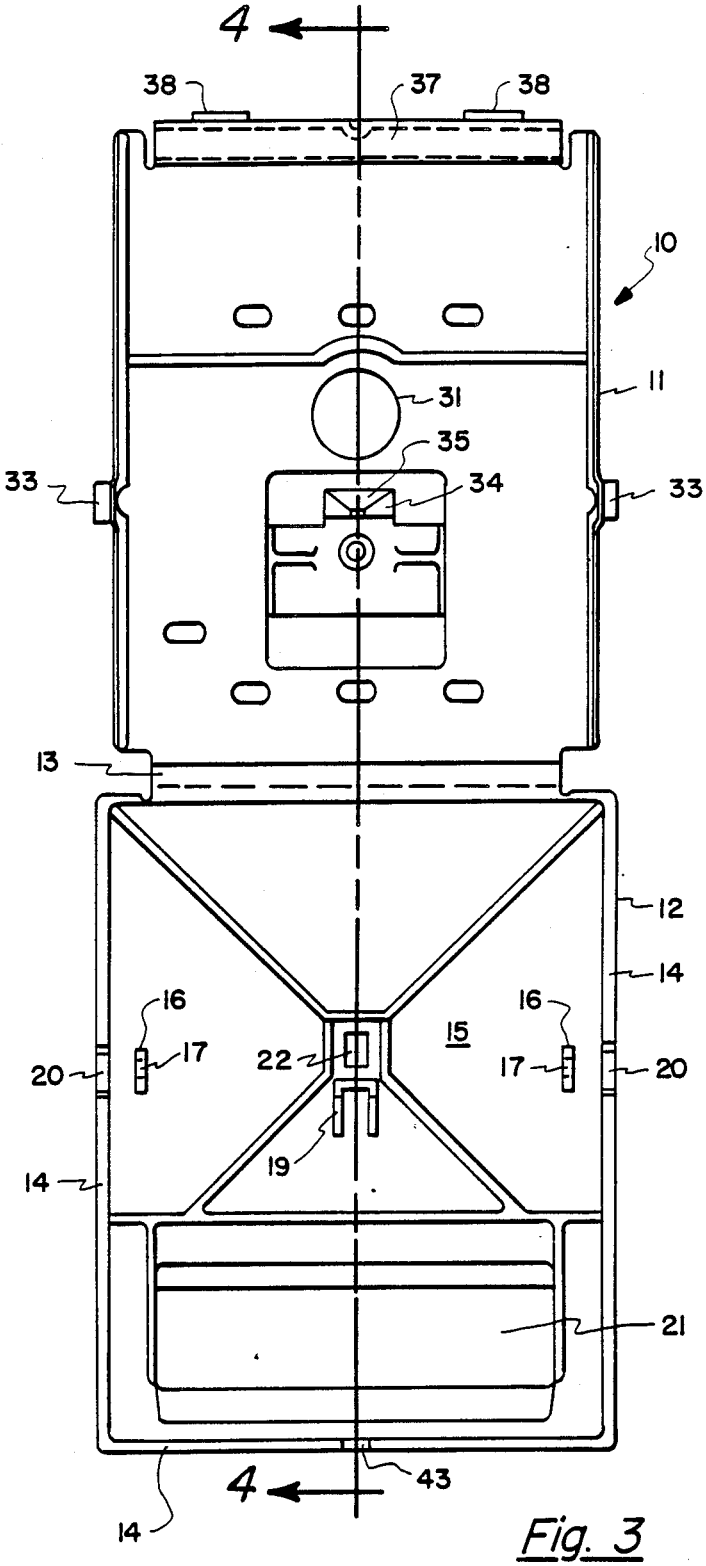
FIG. 3 is an inside view of the pull station fully opened.

Surface 15 of cover portion 12 has projections 16 extending therefrom, these projections having suitable apertures 17 for receiving a glass structure, such as glass bar 18 shown by dotted line in FIG. 1. Projection 19 extending from cover surface 15 provides a supporting surface which prevents glass structure 18 from breaking when glass breaker 34 is cammed past the glass structure as cover 12 is closed against base portion 11. Slots 20 are provided in sidewalls 14 of cover portion 12 to permit insertion of glass structure 18 through apertures 17. Cover portion 12 also has handle 21 in the form of an integral recess in surface 42 to permit manual operation of pull station 10. Cover portion 12 also includes a rectangular opening 22 the purpose of which will be discussed hereinbelow.

Base portion 11 has an aperture 31 therein for receiving switch 32 which, when cover portion 12 is withdrawn from base portion 11 by use of recessed handle 21, will be activated to produce a signal, such as an alarm signal. Base portion 11 also has projections 33 which, when cover portion 12 is closed against base portion 11 will cover slots 20 to prevent access to glass structure 18. Base portion 11 also has glass breaker 34 having a camming surface 35 such that, as cover portion 12 is closed against base portion 11, cam 35 will ride over glass structure 18 until cover portion 12 is fully closed against base portion 11 at which time glass structure 18 will drop down along glass breaking surface 36. At this point, glass breaker 34 is in glass breaking contact with glass structure 18. Thus, when the alarm station is to be activated, cover portion 12 is pulled away from base portion 11 with glass breaking surface 36 of glass breaker 34 breaking glass structure 18 and allowing activation of switch 32.

Figure 4:
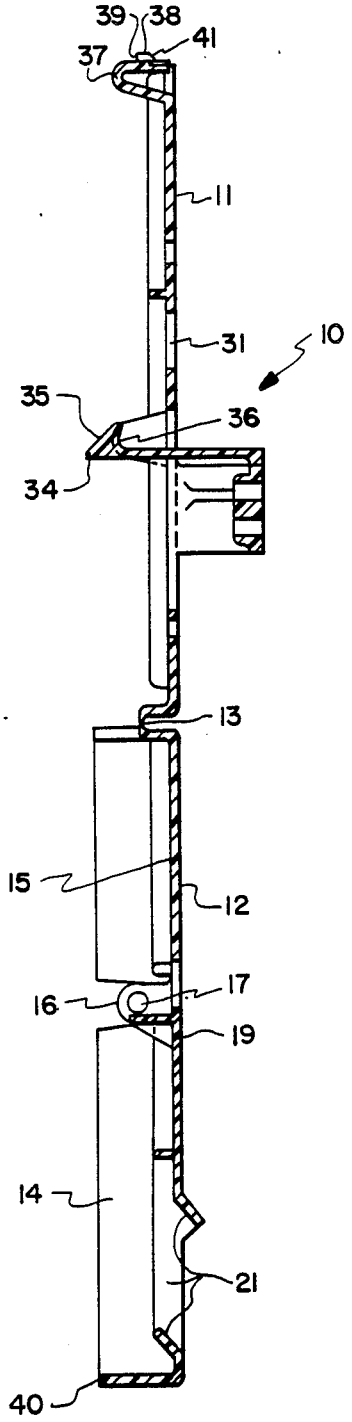
FIG. 4 is a cross sectional side view.

Also, base portion 11 has a closure mechanism 37 which has projections 38 thereon. As best seen in FIG. 4, projections 38 have flat surfaces 39 which abut surface 40 of wall 41 of cover portion 12 during closure of cover portion 12 against base portion 11. This feature prevents the accidential resetting of the pull station and requires a tool, such as a screwdriver, to depress closure mechanism 37 when cover portion 12 is to be closed against base portion 11. Access slot 43 provide clearance for the tool thus allowing removal of the tool when cover 12 is fully closed. To facilitate the pulling of cover portion 12 away from base portion 11, projections 38 have camming surfaces 41.

During installation, glass structure 18 is inserted through apertures 17 of projection 16 and against projection 19 facilitated by slots 20. Cover portion 12 can then be closed against base portion 11 by depressing closure mechanism 37. During closure, cam surface 35 causes glass breaker 34 to ride up and over glass structure 18. At full closure, glass structure 18 drops down along breaking surface 36.

During an emergency condition, if pull station 10 is to be operated, the operator uses recessed handle 21 to pull cover portion 12 away from base portion 11. During this operation, switch 32 is operated and glass breaker 34 breaks glass structure 18.

If the device is to be tested without breaking glass structure 18, a tool, such as a screwdriver, can be inserted through aperture 22 to push glass breaker 34 away from glass structure 18 while cover portion 12 is withdrawn from base portion 11 by use of the recessed handle 21. The activation of switch 32 can therefore be tested without breaking glass structure 18.

Upon operation of pull station 10 during an emergency condition, the pull station can be reset only by use of a tool to depress closure mechanism 37 while cover portion 12 is pushed against base portion 11.

The embodiments of the invention in which an exclusive property or rights is claimed are defined as follows:

1. A pull station for generating an alarm signal upon manual activation comprising:

a housing of unitary construction having integral cover and base portions, said housing also having a hinge integrally formed with said integral cover and base portions, said cover portion having handle means so that said cover portion can be pulled away from said base portion when an alarm signal is to be generated;

break glass holding means provided on one of said portions for receiving a glass structure to be broken when said cover portion is pulled away from said base portion;

glass breaking means having a camming surface to ride past said glass structure when sid portions are closed and having a breaking surface for breaking said glass structure when said cover portion is pulled away from said base portion; and, alarm signal generating means for generating said alarm signal when said cover portion is pulled.

2. The station of claim 1 wherein said handle means is integral with said cover portion.

3. The station of claim 2 wherein said handle means comprises a recess formed into the front surface of said cover portion to accommodate a hand to pull said cover portion from said base portion.

4. The station of claim 3 wherein said cover portion comprises an opening so that said glass breaking means can be moved from glass breaking engagement with said glass structure when said station is to be tested without breaking said glass structure.

5. The station of claim 4 wherein said portions comprise closure means for holding said portions together when said portions are closed, said closure means being arranged so that a tool is required to close said portions.

6. The station of claim 5 wherein said base portion comrpises means for receiving said alarm signal generating means and for permitting removal of said alarm signal generating means.

7. The station of claim 6 wherein said alarm signal generating means comprises a snap in housing compatible with said means for receiving and for permitting removal.

8. The station of claim 1 wherein said base portion comprises means for receiving said alarm signal generating means and for permitting removal of said alarm signal generating means.

9. The station of claim 8 wherein said alarm signal generating means comprises a snap in housing compatible with said means for receiving and for permitting removal.

10. The station of claim 1 wherein said cover portion comprises an opening so that said glass breaking means can be moved from glass breaking engagement with said glass structure when said station is to be tested without breaking said glass structure.

11. The station of claim 10 wherein said portions comprise closure means for holding said portions together when said portions are closed, said closure means being arranged so that a tool is required to close said portions.

12. The station of claim 11 wherein said base portion comprises means for receiving said alarm signal generating means and for permitting removal of said alarm signal generating means.

13. The station of claim 12 wherein said alarm signal generating means comprises a snap in housing compatible with said means for receiving and for permitting removal.

14. A pull station useable for generating an alarm signal upon manual activation comprising:

a housing of unitary construction having integral cover and base portions, said housing having a hinge formed integrally with said integral cover and base portions, said cover portion having handle means so that said cover portion can be pulled away from said base portion;

break glass holding means provided on one of said portions for receiving a glass structure to be broken when said cover portion is pulled away from said base portion; and, glass breaking means provided on the other of said portions, said glass breaking means having a camming surface to ride past said glass structure when said portions are closed and having a breaking surface for breaking said glass structure when said cover portion is pulled away from said base portion.

15. The station of claim 14 wherein said cover portion comprises an opening so that said glass breaking means can be moved from glass breaking engagement with said glass structure when said station is to be tested without breaking said glass structure.

16. The station of claim 15 wherein said portions comprise closure means for holding said portions together when said portions are closed, said closure means being arranged so that a tool is required to close said portions.

17. The station of claim 16 wherein said handle means is integral with said cover portion.

18. The station of claim 17 wherein said handle means comprises a recess formed into the front surface of said cover portion to accommodate a hand to pull said cover portion from said base portion.

19. The station of claim 14 wherein said portions comprise closure means for holding said portions together when said portions are closed, said closure means being arranged so that a tool is required to close said portions.

* * * * *